US006904757B2

(12) United States Patent
Mitchell et al.

(10) Patent No.: US 6,904,757 B2
(45) Date of Patent: Jun. 14, 2005

(54) MOUNTING ASSEMBLY FOR THE FORWARD END OF A CERAMIC MATRIX COMPOSITE LINER IN A GAS TURBINE ENGINE COMBUSTOR

(75) Inventors: Krista Anne Mitchell, Springboro, OH (US); David Edward Bulman, Cincinnati, OH (US); Mark Eugene Noe, Morrow, OH (US); Harold Ray Hansel, Mason, OH (US); Thomas Allen Wells, West Chester, OH (US); Christopher Charles Glynn, Hamilton, OH (US); John David Bibler, Tucson, AZ (US); Toby George Darkins, Jr., Loveland, OH (US); Joseph John Charneski, Maineville, OH (US); Craig Patrick Burns, Mason, OH (US)

(73) Assignee: General Electric Company, Schenectady, NY (US)

( * ) Notice: Subject to any disclaimer, the term of this patent is extended or adjusted under 35 U.S.C. 154(b) by 176 days.

(21) Appl. No.: 10/324,871

(22) Filed: Dec. 20, 2002

(65) Prior Publication Data

US 2004/0118122 A1 Jun. 24, 2004

(51) Int. Cl.[7] ..... F02C 7/20
(52) U.S. Cl. ..... 60/800
(58) Field of Search ..... 60/752, 753, 796, 60/798, 799, 800

(56) References Cited

U.S. PATENT DOCUMENTS 5,117,624 A * 6/1992 Roberts et al. ..... 60/796
5,285,632 A 2/1994 Halila
5,291,732 A 3/1994 Halila
5,291,733 A 3/1994 Halila
5,353,587 A 10/1994 Halila
5,363,643 A 11/1994 Halila
5,592,814 A 1/1997 Palusis et al.
5,996,335 A * 12/1999 Ebel ..... 60/800
6,397,603 B1 6/2002 Edmondson et al. ..... 60/753
6,655,148 B2 * 12/2003 Calvez et al. ..... 60/753
2002/0108378 A1 8/2002 Ariyoshi et al.

OTHER PUBLICATIONS

"ESPR Combustor Concept," Kawasaki Heavy Industries, Ltd. (Mar. 2000), Cover sheet and figure (partially screened).

Hiroyuki Ninomiya et al., "Development of Low NOx LPP Combustor," The First International Symposium of Environmentally Compatible Propulsion System for Next–Generation Supersonic Transport, Tokyo, Japan (May 21–22, 2002), p. 1–6.

* cited by examiner

*Primary Examiner*—Michael Koczo
(74) *Attorney, Agent, or Firm*—William Scott Andess; James P. Davidson

(57) ABSTRACT

A mounting assembly for a forward end of a liner in a combustor of a gas turbine engine including a dome and a cowl, wherein a longitudinal centerline axis extends through the gas turbine engine. The mounting assembly includes a pin member extending through each one of a plurality of circumferentially spaced openings formed in the forward end of the liner, an aft portion of the cowl, and a portion of the dome, with each pin member including a head portion at one end thereof. A nut is adjustably connected to an end of each pin member opposite the head portion. A bushing is located on each pin member at a position intermediate the head portion and the nut, wherein the openings in the liner forward end are sized to fit around the bushings. In this way, the cowl aft portion and the dome portion are fixedly connected together between the bushing and the nut so that the bushings are able to slide radially through the openings in the liner forward end as the cowl and the dome experience thermal growth greater than the liner.

25 Claims, 7 Drawing Sheets

MOUNTING ASSEMBLY FOR THE FORWARD END OF A CERAMIC MATRIX COMPOSITE LINER IN A GAS TURBINE ENGINE COMBUSTOR

STATEMENT REGARDING FEDERALLY SPONSORED RESEARCH AND DEVELOPMENT

The U.S. Government may have certain rights in this invention pursuant to contract number NAS3-27720.

BACKGROUND OF THE INVENTION

The present invention relates generally to the use of Ceramic Matrix Composite (CMC) liners in a gas turbine engine combustor and, in particular, to the mounting of such CMC liners to the dome and cowl of the combustor so as to accommodate differences in thermal growth therebetween.

It will be appreciated that the use of non-traditional high temperature materials, such as Ceramic Matrix Composites (CMC), are being studied and utilized as structural components in gas turbine engines. There is particular interest, for example, in making combustor components which are exposed to extreme temperatures from such material in order to improve the operational capability and durability of the engine. As explained in U.S. Pat. No. 6,397,603 to Edmondson et al., substitution of materials having higher temperature capabilities than metals has been difficult in light of the widely disparate coefficients of thermal expansion when different materials are used in adjacent components of the combustor. This can result in a shortening of the life cycle of the components due to thermally induced stresses, particularly when there are rapid temperature fluctuations which can also result in thermal shock.

Accordingly, various schemes have been employed to address problems that are associated with mating parts having differing thermal expansion properties. As seen in U.S. Pat. No. 5,291,732 to Halila, U.S. Pat. No. 5,291,733 to Halila, and U.S. Pat. No. 5,285,632 to Halila, an arrangement is disclosed which permits a metal heat shield to be mounted to a liner made of CMC so that radial expansion therebetween is accommodated. This involves positioning a plurality of circumferentially spaced mount pins through openings in the heat shield and liner so that the liner is able to move relative to the heat shield.

U.S. Pat. No. 6,397,603 to Edmondson et al. also discloses a combustor having a liner made of Ceramic Matrix Composite materials, where the liner is mated with an intermediate liner dome support member in order to accommodate differential thermal expansion without undue stress on the liner. The Edmondson et al. patent further includes the ability to regulate part of the cooling air flow through the interface joint.

While each of the aforementioned patents reveals mounting arrangements for a CMC liner which are useful for their particular combustor designs, none involve a liner made of CMC materials being connected directly to the dome and cowl portions of the combustor in a single mounting arrangement. Thus, it would be desirable for a simple mounting assembly to be developed for a liner having a different coefficient of thermal expansion than the components to which it is mated. It would also be desirable for such mounting assembly to permit improved flow of air around such interface while minimizing changes in the combustor structure over previous configurations.

BRIEF SUMMARY OF THE INVENTION

In a first exemplary embodiment of the invention, a mounting assembly for a forward end of a liner in a combustor of a gas turbine engine including a dome and a cowl is disclosed, wherein a longitudinal centerline axis extends through the gas turbine engine. The mounting assembly includes a pin member extending through each one of a plurality of circumferentially spaced openings formed in the forward end of the liner, an aft portion of the cowl, and a portion of the dome, with each pin member including a head portion at one end thereof. A nut is adjustably connected to an end of each pin member opposite the head portion. A bushing is located on each pin member at a position intermediate the head portion and the nut, wherein the openings in the liner forward end are sized to fit around the bushings. In this way, the cowl aft portion and the dome portion are fixedly connected together between the bushing and the nut so that the bushings are able to slide radially through the openings in the liner forward end as the cowl and the dome experience thermal growth greater than the liner.

In a second exemplary embodiment of the invention, a combustor for a gas turbine engine having a longitudinal centerline axis extending therethrough is disclosed as including: an outer liner having a forward end and an aft end, where the outer liner is made of a ceramic matrix composite material; an annular dome having an outer portion and an inner portion, where the dome is made of a metal; a plurality of fuel/air mixers connected to and circumferentially spaced within the dome; an outer cowl located forward of the dome outer portion having a forward end and an aft end, where the outer cowl is made of a metal; and, an assembly for mounting the outer liner to the outer cowl and the dome outer portion, wherein the outer cowl and the dome outer portion are fixedly connected together and movably connected to the outer liner in a radial direction as the outer cowl and the dome outer portion experience thermal growth greater than the outer liner.

In accordance with a third exemplary embodiment of the invention, a combustor for a gas turbine engine having a longitudinal centerline axis extending therethrough is disclosed as including: an inner liner having a forward end and an aft end, where the inner liner is made of a ceramic matrix composite material; an annular dome having an outer portion and an inner portion, where the dome is made of a metal; a plurality of fuel/air mixers connected to and circumferentially spaced within the dome; an inner cowl located forward of the dome inner portion having a forward end and an aft end, where the inner cowl is made of a metal; and, an assembly for mounting the inner liner to the inner cowl and the dome inner portion, wherein the inner cowl and said dome inner portion are fixedly connected together and movably connected to the inner liner in a radial direction as the inner cowl and the dome inner portion experience thermal growth greater than the inner liner.

In accordance with a fourth exemplary embodiment of the invention, a method of mounting a liner to a dome and a cowl in a gas turbine engine combustor having a longitudinal centerline axis therethrough is disclosed, wherein the liner is made of a material having a lower coefficient of thermal expansion than the dome and the cowl. The method includes the steps of fixedly connecting an aft portion of the cowl and a portion of the dome and connecting a forward end of the liner to the cowl aft portion and the dome portion in a manner so as to permit radial movement of the cowl aft end and the dome portion with respect to the liner forward end. The method may also include the step of connecting the forward end of the liner to the cowl aft portion and the dome portion in a manner so as to prevent axial and/or circumferential movement of the cowl aft end and the dome portion with respect to the liner forward end.

DETAILED DESCRIPTION OF THE INVENTION

Figure 1:
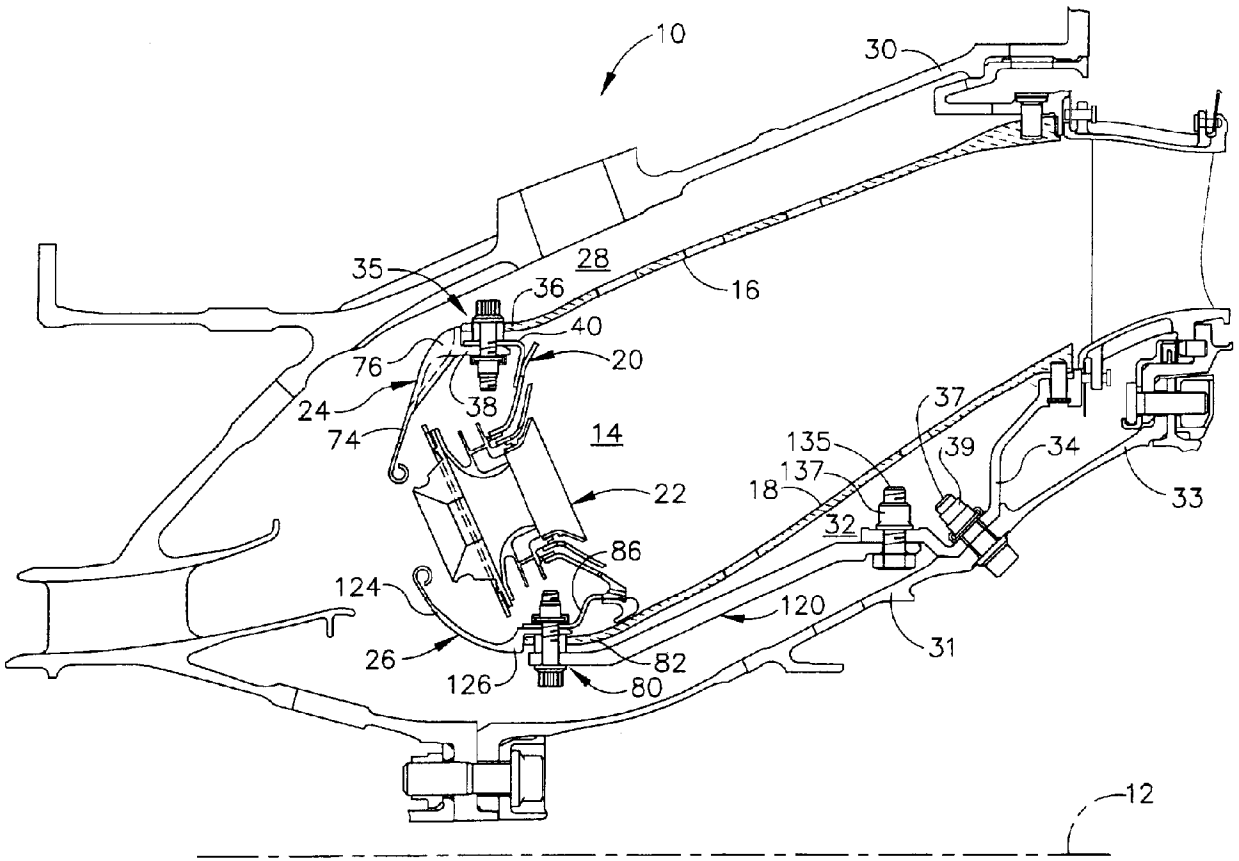
FIG. 1 is a longitudinal cross-sectional view of a gas turbine engine combustor including an outer liner and an inner liner mounted in accordance with the present invention.

Referring now to the drawings in detail, wherein identical numerals indicate the same elements throughout the figures, FIG. 1 depicts an exemplary gas turbine engine combustor 10 which conventionally generates combustion gases that are discharged therefrom and channeled to one or more pressure turbines. Such turbine(s) drive one or more pressure compressors upstream of combustor 10 through suitable shaft(s). A longitudinal or axial centerline axis 12 is provided through the gas turbine engine for reference purposes.

It will be seen that combustor 10 further includes a combustion chamber 14 defined by an outer liner 16, an inner liner 18 and a dome 20. Combustor dome 20 is shown as being single annular in design so that a single circumferential row of fuel/air mixers 22 are provided within openings formed in such dome 20, although a multiple annular dome may be utilized. A fuel nozzle (not shown) provides fuel to fuel/air mixers 22 in accordance with desired performance of combustor 10 at various engine operating states. It will also be noted that an outer annular cowl 24 and an inner annular cowl 26 are located upstream of combustion chamber 14 so as to direct air flow into fuel/air mixers 22, as well as an outer passage 28 between outer liner 16 and an outer casing 30 and an inner passage 32 between inner liner 18 and an inner casing 31. An inner annular support member 34 is further shown as being connected to a nozzle support 33 by a plurality of bolts 37 and nuts 39. In this way, convective cooling air is provided to the outer and inner surfaces of outer and inner liners 16 and 18, respectively, and air for film cooling is provided to the inner and outer surfaces of such liners. A diffuser (not shown) receives the air flow from the compressor(s) and provides it to combustor 10.

It will be appreciated that outer and inner liners 16 and 18 are preferably made of a Ceramic Matrix Composite (CMC), which is a non-metallic material having high temperature capability and low ductility. Exemplary composite materials utilized for such liners include silicon carbide, silicon, silica or alumina matrix materials and combinations thereof. Typically, ceramic fibers are embedded within the matrix such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y and combinations thereof) and inorganic fillers (e.g., pyrophyllite, wollastonite, mica, talc, kyanite and montmorillonite). CMC materials typically have coefficients of thermal expansion in the range of about $1.3\times10^{-6}$ in/in/° F. to about $3.5\times10^{-6}$ in/in/° F. in a temperature of approximately 1000–1200° F.

By contrast, dome 20, outer cowl 24, and inner cowl 26 are typically made of a metal, such as a nickel-based superalloy (having a coefficient of thermal expansion of about $8.3–8.5\times10^{-6}$ in/in/° F. in a temperature of approximately 1000–1200° F.) or cobalt-based superalloy (having a coefficient of thermal expansion of about $7.8–8.1\times10^{-6}$ in/in/° F. in a temperature of approximately 1000–1200° F.). Thus, liners 16 and 18 are better able to handle the extreme temperature environment presented in combustion chamber 14 due to the materials utilized therefor, but attaching them to the different materials utilized for dome 20 and cowls 24 and 26 presents a separate challenge. Among other limitations, components cannot be welded to the CMC material of outer and inner liners 16 and 18.

Figure 2:
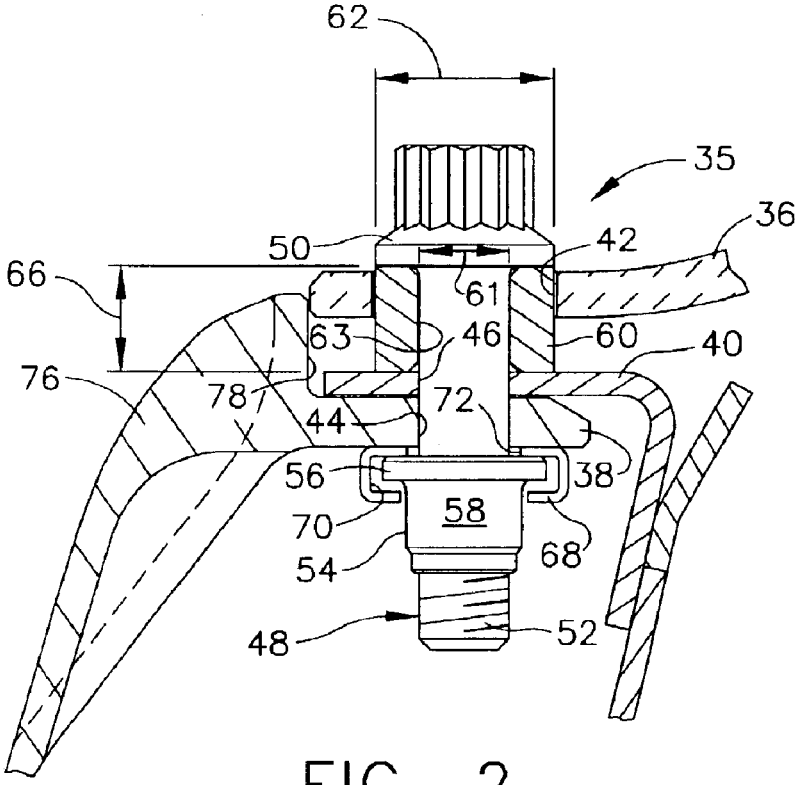
FIG. 2 is an enlarged, partial cross-sectional view of the combustor depicted in FIG. 1, where an embodiment of the mounting assembly for a forward end of the outer liner is shown prior to any thermal growth experienced by the outer liner, the outer cowl aft end and the dome outer portion.
Figure 3:
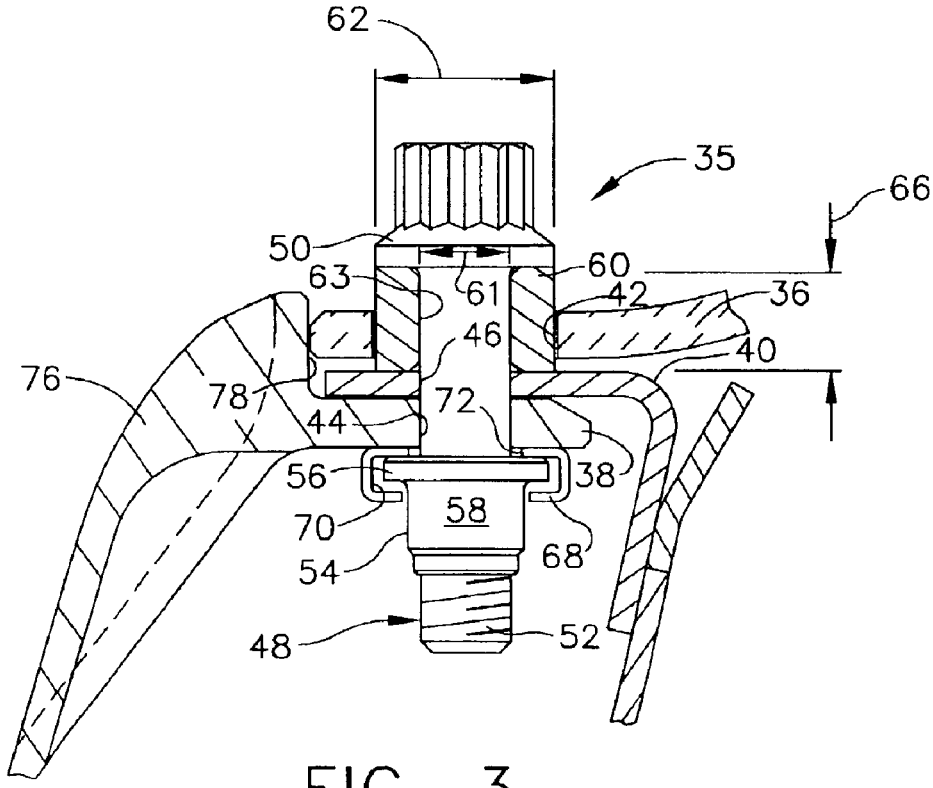
FIG. 3 is an enlarged, partial cross-sectional view of the combustor depicted in FIG. 1, where the embodiment of the mounting assembly for a forward end of the outer liner of FIG. 2 is shown after thermal growth is experienced by the outer liner, the outer cowl aft end and the dome outer portion.

Accordingly, it will be seen in FIGS. 2 and 3 that a mounting assembly 35 is provided for forward end 36 of outer liner 16, an aft portion 38 of outer cowl 24, and an outer portion 40 of dome 20 so as to accommodate varying thermal growth experienced by such components. It will be appreciated that the mounting arrangement shown in FIG. 2 is prior to any thermal growth experienced by outer liner 16, outer cowl aft portion 38 and dome outer portion 40. As seen in FIG. 3, however, outer liner 16, outer cowl aft portion 38 and dome outer portion 40 have each experienced thermal growth, with outer cowl aft portion 38 and dome outer portion 40 having experienced greater thermal growth than outer liner 16 due to their higher coefficients of thermal expansion. Accordingly, outer cowl aft portion 38 and dome outer portion 40 are depicted as being permitted to slide or move in a radial direction with respect to longitudinal centerline axis 12 toward outer liner 16.

More specifically, it will be understood that outer liner forward end 36, outer cowl aft portion 38 and dome outer portion 40 each include a plurality of circumferentially spaced openings 42, 44 and 46, respectively, which are positioned so as to be in alignment. A pin member 48 preferably extends through each set of aligned openings and includes a head portion 50 at a first end thereof. Pin members 48 preferably include threads 52 formed thereon so that a nut 54 is adjustably connected to a second end of each pin member 48 opposite head portion 50. It will be noted that each nut 54 preferably includes a flange portion 56 extending from an outer surface 58 thereof. A bushing 60 is also preferably located on each pin member 48 and fixed at a position intermediate head portion 50 and nut 54 between head portion 50 and dome outer portion 40. In this way, nuts 54 and head portions 50 fixedly connect together cowl aft portion 38, dome outer portion 40 and bushings 60. It will be understood that while dome outer portion 40 is located between outer cowl aft portion 38 and bushings 60, combustor 10 could be configured so that outer cowl aft portion 38 is located between dome outer portion 40 and bushings 60.

Openings 42 in outer liner forward end 36 are preferably sized, however, so that bushings 60 are able to slide radially therethrough as outer cowl aft portion 38 and dome outer portion 40 experience greater thermal growth than outer liner forward end 36. Thus, outer cowl aft portion 38 and dome outer portion 40 are able to move between a first radial position (see FIG. 2) and a second radial position (see FIG. 3). As seen in the figures, a height 66 of bushings 60 should be sized great enough to accommodate the radial thermal growth of outer cowl aft portion 38 and dome outer portion 40. In order to provide the clamping of bushings 60 with dome outer portion 40 and outer cowl aft portion 38, however, pin head portion 50 will have a diameter 62 greater than a diameter 61 of opening 63 in bushings 60.

It is preferred that cowl aft portion 38 and dome outer portion 40 not be able to move axially or circumferentially with respect to outer liner forward end 36. Accordingly, an annular member 68 (which preferably may include a plurality of arcuate segments) having a channel 70 formed therein is provided adjacent cowl aft portion 38. A plurality of circumferentially spaced openings 72 are formed in annular member 68 which are aligned with openings 42 in outer liner forward end 36, openings 44 in outer cowl aft portion 38 and openings 46 in dome outer portion 40. Nuts 54 are then positioned so that flange portions 56 thereof are located within channel 70 and fixedly connect outer cowl aft portion 38, dome outer portion 40, bushings 60 and annular member 68.

It will also be seen that outer cowl 24 is configured in a manner to accommodate mounting assembly 35. More specifically, outer cowl 24 includes a forward portion 74, aft portion 38, and an intermediate portion 76. Outer cowl aft portion 38 is preferably a flange which is stepped from outer cowl intermediate portion 76 by an amount substantially equivalent to height 66 of bushings 60 as seen by surface 78. It will also be understood that outer cowl intermediate portion 76 is configured to shield mounting assembly 35, and specifically bushings 60, from undesirable air flow entering outer passage 28.

Figure 4:
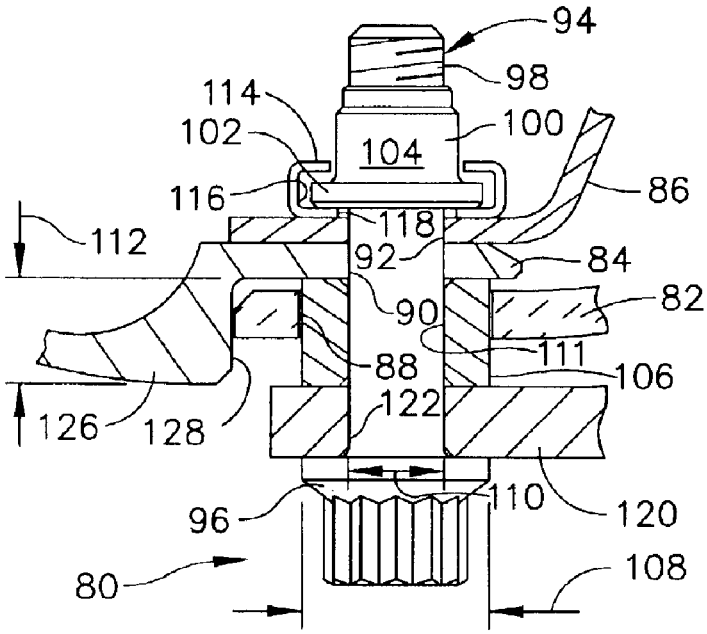
FIG. 4 is an enlarged, partial cross-sectional view of the combustor depicted in FIG. 1, where an embodiment of the mounting assembly for a forward end of the inner liner is shown prior to any thermal growth experienced by the inner liner, the inner cowl aft end and the dome inner portion.
Figure 5:
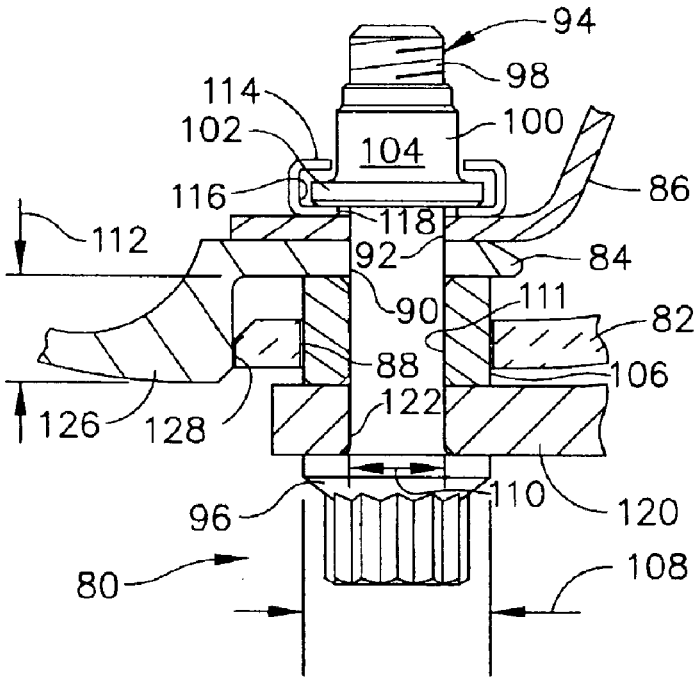
FIG. 5 is an enlarged, partial cross-sectional view of the combustor depicted in FIG. 1, where the embodiment of the mounting assembly for a forward end of the inner liner of FIG. 4 is shown after thermal growth is experienced by the inner liner, the inner cowl aft end and the dome inner portion.

Similarly, it will be seen in FIG. 4 that a mounting assembly 80 is provided for a forward end 82 of inner liner 18, an aft portion 84 of inner cowl 26, and an inner portion 86 of dome 20 so as to accommodate differences in thermal growth experienced by such components. It will be appreciated that the mounting assembly shown in FIG. 4 is prior to any thermal growth experienced by inner liner 18, inner cowl aft portion 84 and dome inner portion 86. As seen in FIG. 5, inner liner 18, inner cowl aft portion 84 and dome inner portion 86 have each experienced thermal growth, with inner cowl aft portion 84 and dome inner portion 86 having experienced greater thermal growth than inner liner 18 due to their higher coefficients of thermal expansion. Accordingly, inner cowl aft portion 84 and dome inner portion 86 are depicted as being permitted to slide or move in a radial direction with respect to longitudinal centerline axis 12 away from inner liner 18.

More specifically, it will be understood that inner liner forward end 82, inner cowl aft portion 84 and dome inner portion 86 each include a plurality of circumferentially spaced openings 88, 90 and 92, respectively, which are positioned so as to be in alignment. A pin member 94 preferably extends through each set of aligned openings and includes a head portion 96 at a first end thereof. Pin members 94 preferably include threads 98 formed thereon so that a nut 100 is adjustably connected to a second end of each pin member 94 opposite head portion 96. It will be noted that each nut 100 preferably includes a flange portion 102 extending from an outer surface 104 thereof. A bushing 106 is also preferably located on each pin member 94 and fixed at a position intermediate head portion 96 and nut 100 between head portion 96 and inner cowl aft portion 84. In this way, nuts 100 and head portions 96 fixedly connect together inner cowl aft portion 84, dome inner portion 86 and bushings 106. It will be understood that while inner cowl aft portion 84 is located between dome inner portion 86 and bushings 106, combustor 10 could be configured so that dome inner portion 86 is located between inner cowl aft portion 84 and bushings 106.

Openings 88 in inner liner forward end 82 are preferably sized, however, so that bushings 106 are able to slide radially therethrough as inner cowl aft portion 84 and dome inner portion 86 experience thermal growth greater than inner liner forward end 82. Thus, inner cowl aft portion 84 and dome inner portion 86 are able to move between a first radial position (see FIG. 4) and a second radial position (see FIG. 5). As seen in the figures, a height 112 of bushings 106 should be sized great enough to accommodate the radial thermal growth of inner cowl aft portion 84 and dome inner portion 86. In order to provide the clamping of bushings 106 with inner cowl aft portion 84 and dome inner portion 86, however, pin head portion 96 will have a diameter 108 greater than a diameter 110 of an opening 111 in bushings 106.

It is preferred that inner cowl aft portion 84 and dome inner portion 86 not be able to move axially or circumferentially with respect to inner liner forward end 82. Accordingly, an annular member 114 having a channel 116 formed therein is provided adjacent dome inner portion 86. A plurality of circumferentially spaced openings 118 are formed in annular member 114 which are aligned with openings 88 in inner liner forward end 82, openings 90 in inner cowl aft portion 84 and openings 92 in dome inner portion 86. Nuts 100 are then positioned so that flange portions 102 thereof are located within channel 116 and fixedly connect bushings 106, inner cowl aft portion 84, dome inner portion 86 and annular member 114.

Figure 6:
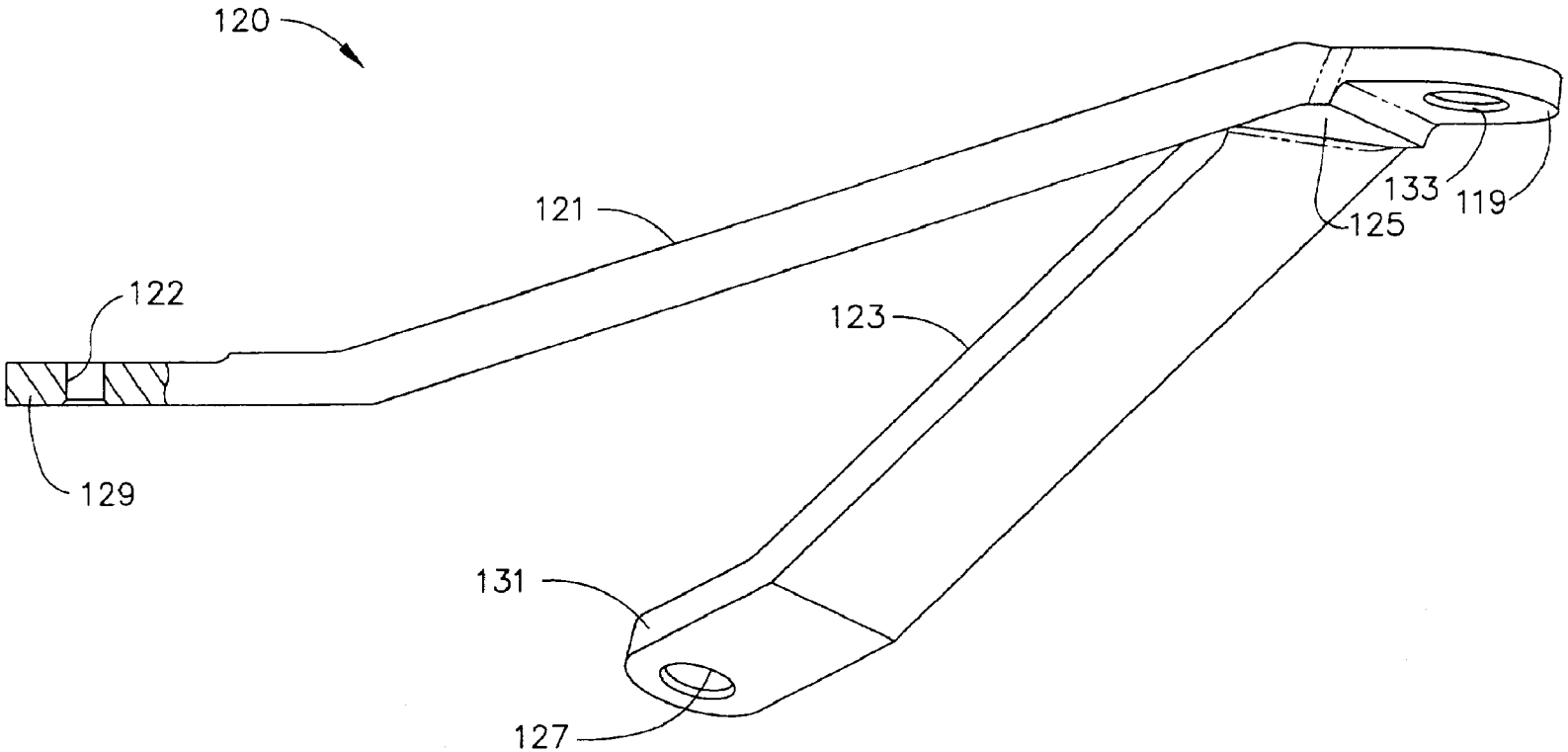
FIG. 6 is a perspective view of a drag link depicted in FIG. 1.

It will further be seen that a plurality of circumferentially spaced support members 120 (known as a drag link) are connected to inner support member 34 and extend axially forward to be movably connected with inner liner forward end 82. In particular, FIG. 6 shows that each drag link 120 has a wishbone-type shape and includes first and second portions 121 and 123 which extend from a common junction portion 125. First and second drag link portions 121 and 123 each include an opening 122 and 127 formed in a forward portion 129 and 131, respectively, thereof which are in alignment with adjacent openings 88, 90 and 92 of inner liner forward end 82, inner cowl aft portion 84 and dome inner portion 86. In this way, pin members 94 are able to extend therethrough so that first and second portions 121 and 123 of drag link 120 are clamped between pin head portions 96 and bushings 106. Accordingly, forward portions 129 and 131 are spaced so that at least one pin member 94 of mounting assembly 80 is positioned therebetween. An aft portion 125 of each drag link 120 includes an opening 133 therein so that it may be connected to inner annular support member 34 via a bolt 135 and nut 137. It will be appreciated that drag links 120 are provided to assist in minimizing vibrations by providing a measure of stiffness to combustor 10.

It will also be seen that inner cowl 26 is also preferably configured in a manner to accommodate mounting assembly 80. More specifically, inner cowl 26 includes a forward portion 124, aft portion 84, and an intermediate portion 126. Inner cowl aft portion 84 is preferably a flange which is stepped from inner cowl intermediate portion 126 by an amount substantially equivalent to height 112 of bushings 106 as seen by surface 128. It will also be understood that inner cowl intermediate portion 126 is configured to shield mounting assembly 80, and specifically bushings 106, from undesirable air flow entering inner passage 32.

Figure 7:
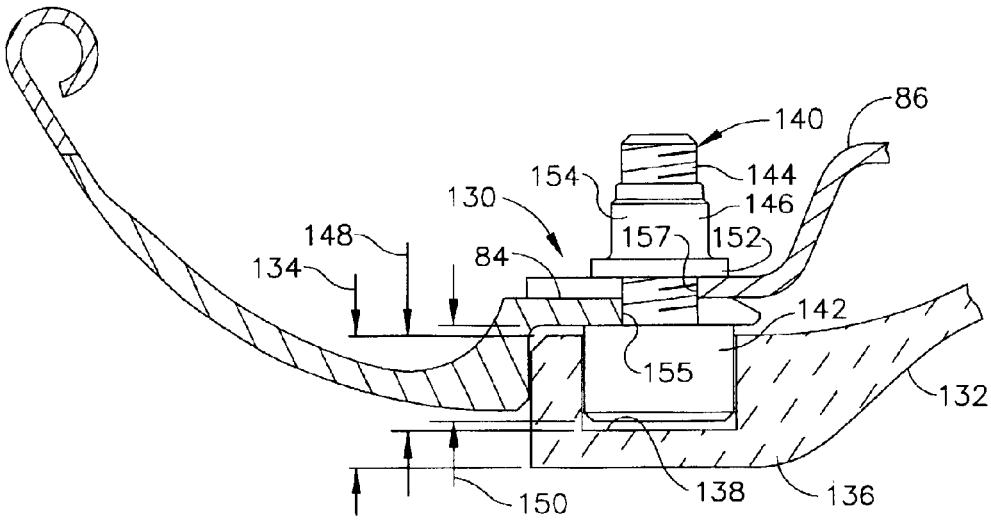
FIG. 7 is an enlarged, partial cross-sectional view of the combustor depicted in FIG. 1, where an alternative embodiment of the mounting assembly for a forward end of the inner liner is shown prior to any thermal growth experienced by the inner liner, the inner cowl aft end and the dome inner portion.
Figure 8:
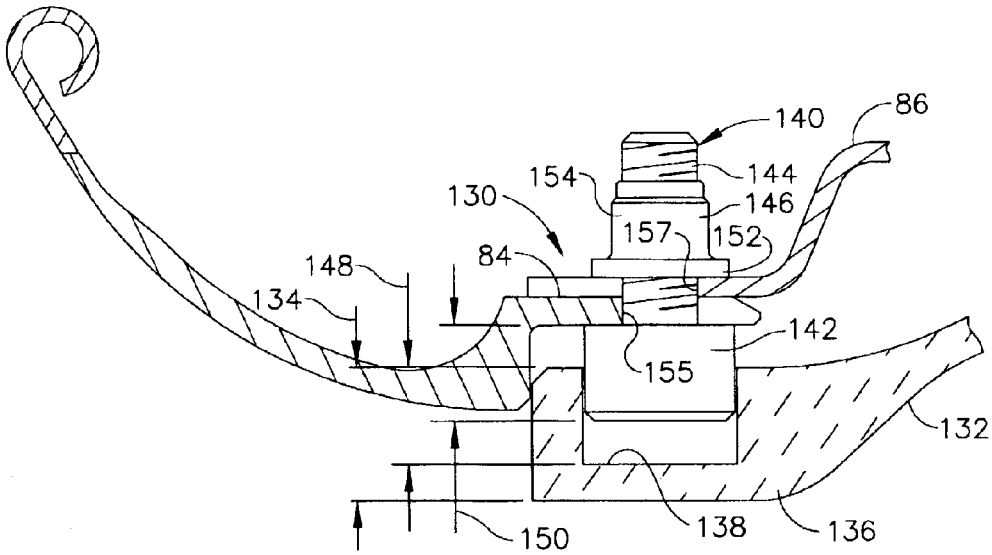
FIG. 8 is an enlarged, partial cross-sectional view of the combustor depicted in FIG. 1, where the alternative embodiment of the mounting assembly for a forward end of the inner liner of FIG. 7 is shown after thermal growth is experienced by the inner liner, the inner cowl aft end and the dome inner portion.
Figure 9:
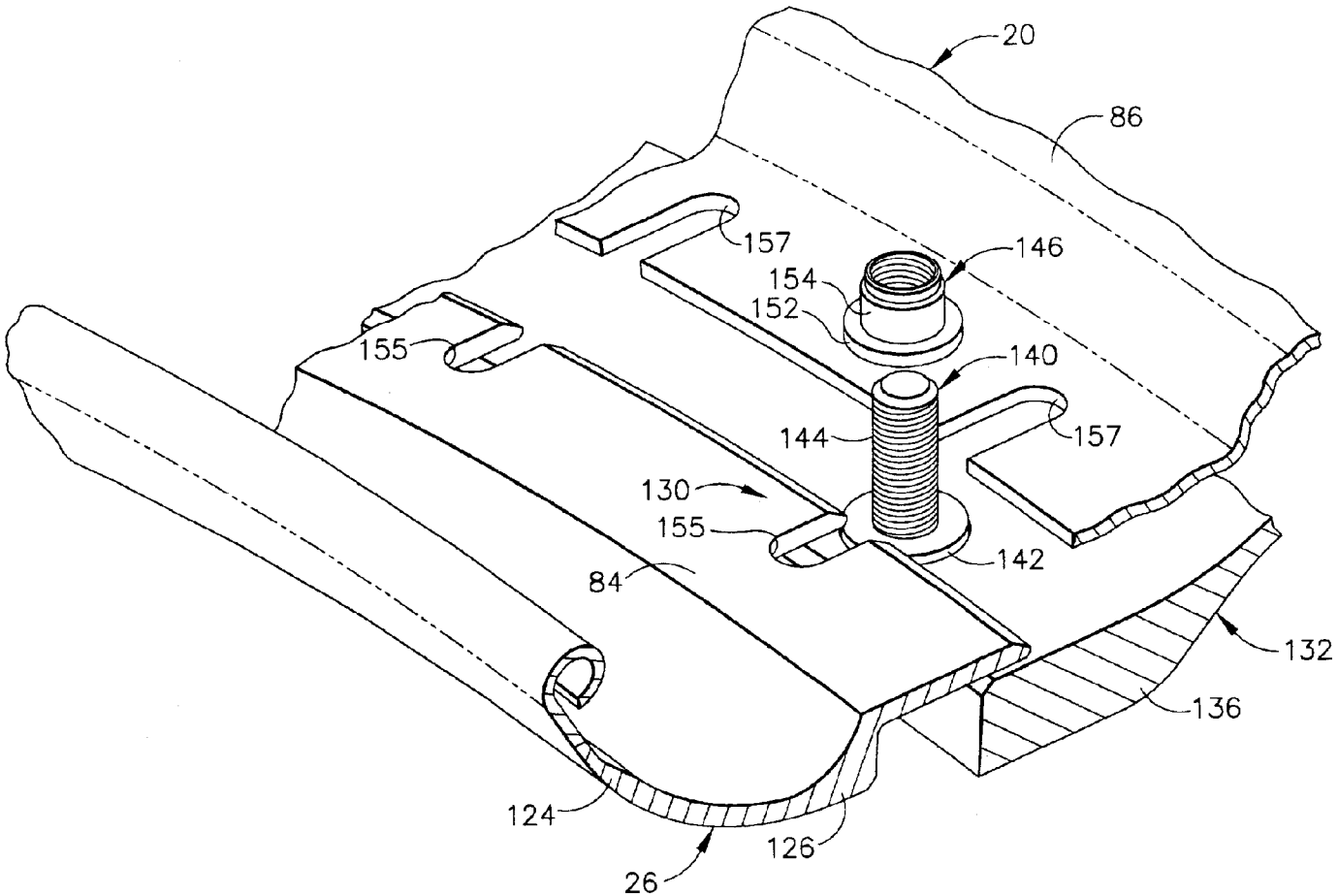
FIG. 9 is a partial exploded perspective view of the mounting assembly depicted in FIGS. 7 and 8 prior to the nut being positioned on the pin member.

An alternative mounting assembly 130 for an inner liner 132 having an increased thickness 134 at a forward end 136 is depicted in FIGS. 7–9. It will be seen that a plurality of circumferentially spaced partial openings 138 are formed therein so as to be aligned with openings (preferably mated slots 155 and 157) formed in inner cowl aft portion 84 and dome inner portion 86. A pin member 140 preferably extends through each set of mated slots 155 and 157 and includes a head portion 142 at a first end thereof which is sized so as to be located within each partial opening 138. Pin members 140 preferably include threads 144 formed thereon so that a nut 146 is adjustably connected to a second end of each pin member 140 opposite head portion 142. In this way, inner cowl aft portion 84 and dome inner portion 86 are fixedly connected between nut 146 and pin head portion 142. Head portion 142 of pin members 140 is then able to slide radially in partial openings 138 as inner cowl aft portion 84 and dome inner portion 86 experience thermal growth greater than inner liner forward end 82. Of course, a depth 148 of partial opening 138 and a height 150 of head portion 142 are sized so as to accommodate a designated amount of thermal growth for inner cowl aft portion 84 and dome inner portion 86. It will be appreciated that any type of anti-rotational feature will preferably be utilized with pin member 166, including one incorporated into the interior of pin head portion 168 instead of just the exterior feature to pin member 166 shown.

It will be noted that each nut 146 preferably includes a flange portion 152 extending from an outer surface 154 thereof. Although not shown, it will be appreciated that an annular member having a channel like those identified by reference numerals 68 and 114 and described above may be positioned between nut 146 and dome inner portion 86 to prevent axial and circumferential movement of inner cowl aft portion 84 and dome inner portion 86 with respect to inner liner forward end 82.

It will be seen in FIG. 9 that a plurality of circumferentially spaced and corresponding slots 155 and 157 are preferably formed in inner cowl aft portion 84 and dome inner portion 86, respectively, in order to assist in the assembly of inner cowl aft portion 84 and dome inner portion 86 via mounting assembly 80. Pin members 140 are preferably pre-positioned in partial openings 138. Thereafter, inner cowl aft portion 84 is moved aft and dome inner portion 86 is moved forward so that each pin member 140 is located therebetween. Nuts 146 are then threaded onto pin members 140 to fixedly connect inner cowl aft portion 84 and inner dome portion 86 between head portions 142 of pin members 140 and nuts 146. It will also be appreciated that mounting assembly 80 may be utilized with an inner cowl and dome which are segmented circumferentially.

Figure 10:
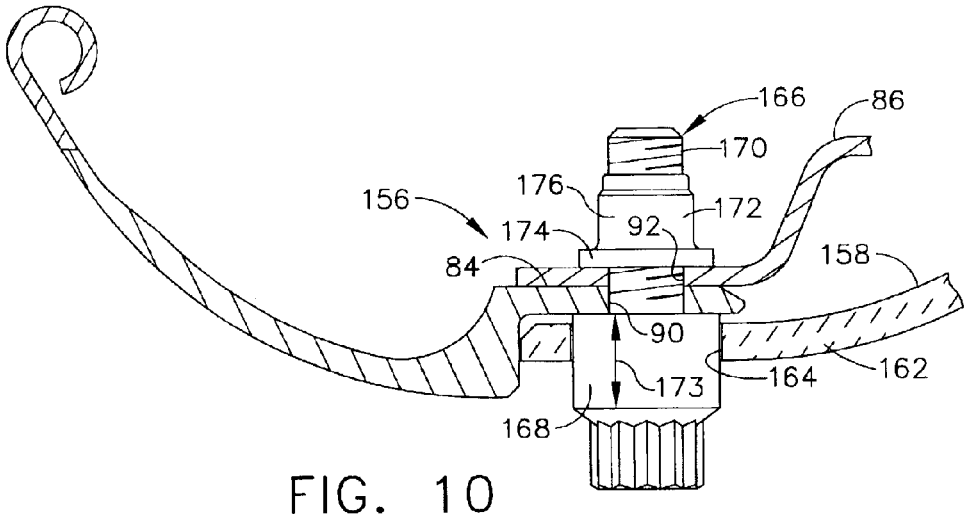
FIG. 10 is an enlarged, partial cross-sectional view of the combustor depicted in FIG. 1, where a second alternative embodiment of the mounting assembly for a forward end of the inner liner is shown prior to any thermal growth experienced by the inner liner, the inner cowl aft end and the dome inner portion; and, FIG. 11 is an enlarged, partial cross-sectional view of the combustor depicted in FIG. 1, where the second alternative embodiment of the mounting assembly for a forward end of the inner liner of FIG. 10 is shown after thermal growth is experienced by the inner liner, the inner cowl aft end and the dome inner portion.
Figure 11:
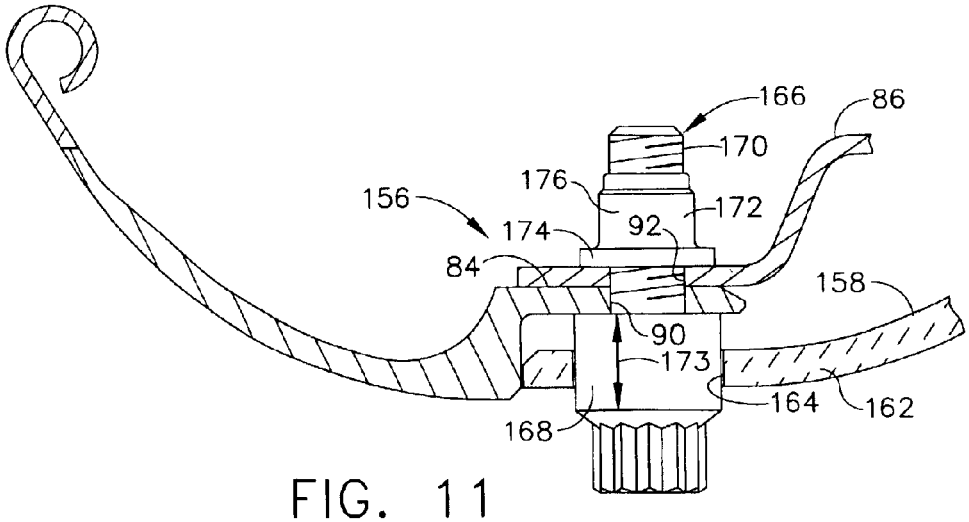

A second alternative mounting assembly 156 for an inner liner 158 having a substantially uniform thickness at a forward end 162 is depicted in FIGS. 10 and 11. It will be seen that a plurality of circumferentially spaced openings 164 are formed therein so as to be aligned with openings 90 and 92 formed in inner cowl aft portion 84 and dome inner portion 86. A pin member 166 preferably extends through each set of aligned openings 90 and 92 and includes a head portion 168 at a first end thereof which is sized so as to be radially movable through each opening 164. Pin members 166 preferably include threads 170 formed thereon so that a nut 172 is adjustably connected to a second end of each pin member 166 opposite head portion 168. In this way, inner cowl aft portion 84 and dome inner portion 86 are fixedly connected between nut 172 and pin head portion 168. Head portion 168 of pin members 166 is then able to slide radially through openings 164 as inner cowl aft portion 84 and dome inner portion 86 experience thermal growth greater than inner liner forward end 82. Of course, a height 173 of head portion 168 is sized so as to accommodate a designated amount of thermal growth for inner cowl aft portion 84 and dome inner portion 86.

It will be noted that each nut 172 preferably includes a flange portion 174 extending from an outer surface 176 thereof. Although not shown, it will be appreciated that an annular member having a channel like those identified by reference numerals 68 and 114 and described above may be positioned between nut 172 and dome inner portion 86 to prevent axial and circumferential movement of inner cowl aft portion 84 and dome inner portion 86 with respect to inner liner forward end 82.

Each of the mounting assemblies described herein reflect a method of mounting outer liner 16 to dome 20 and an outer cowl 24 in a combustor 10. Since outer liner 16 is made of a material having a lower coefficient of thermal expansion than dome 20 and outer cowl 24, the method includes a first step of fixedly connecting outer cowl aft portion 38 and dome outer portion 40. Secondly, outer liner forward end 36 is connected to outer cowl aft portion 38 and dome outer portion 40 in a manner so as to permit radial movement of outer cowl aft portion 38 and dome outer portion 40 with respect to outer liner forward end 36. An additional step of the method preferably includes connecting outer liner forward end 36 to outer cowl aft portion 38 and dome outer portion 40 in a manner so as to prevent axial movement of outer cowl aft end 38 and dome outer portion 40 with respect to outer liner forward end 36. A further additional step of the method preferably includes connecting outer liner forward end 36 to outer cowl aft portion 38 and dome outer portion 40 in a manner so as to prevent circumferential movement of outer cowl aft end 38 and dome outer portion 40 with respect to outer liner forward end 36. Of course, such method steps are equally applicable to inner liner forward end 82, inner cowl aft portion 84 and dome inner portion 86 in a similar manner.

Having shown and described the preferred embodiment of the present invention, further adaptations of the mounting assemblies for a forward end of a combustor liner can be accomplished by appropriate modifications by one of ordinary skill in the art without departing from the scope of the invention. In particular, it will be appreciated that mounting assemblies 130 and 156, while described with respect to an inner liner, may also be utilized with an outer liner having a similar configuration (i.e., increased thickness at a forward end thereof for mounting assembly 130) with either partial openings or complete openings formed therein.

What is claimed is:

1. A mounting assembly for a forward end of a liner in a combustor of a gas turbine engine including a dome and a cowl, wherein a longitudinal centerline axis extends through said gas turbine engine, said mounting assembly comprising:

(a) a pin member extending through each one of a plurality of circumferentially spaced openings formed in said forward end of said liner, an aft portion of said cowl, and a portion of said dome, each said pin member including a head portion at one end thereof;

(b) a nut adjustably connected to an end of each said pin member opposite said head portion; and, (c) a bushing located on each said pin member at a position intermediate said head portion and said nut, wherein said openings in said liner forward end are sized to fit around said bushings;

wherein said cowl aft portion and said dome portion are fixedly connected together between said bushing and said nut so that said bushings are able to slide radially through said openings in said liner forward end as said cowl and said dome experience thermal growth greater than said liner.

2. The liner mounting assembly of claim 1, each said nut further comprising a flange portion extending from an outer surface thereof.

3. The liner mounting assembly of claim 2, further comprising an annular channel member located adjacent one of said cowl aft portion and said dome portion, said annular channel member including a plurality of circumferentially spaced openings formed therein aligned with said openings in said liner forward end, said cowl aft portion and said dome portion so that said nut flange portions are retained in said annular channel member to prevent axial and circumferential movement of said cowl aft portion and said dome portion with respect to said liner forward end.

4. The liner mounting assembly of claim 1, wherein said liner is made of a ceramic matrix material.

5. The liner mounting assembly of claim 1, wherein said cowl and said dome are made of a metal.

6. The liner mounting assembly of claim 1, wherein said cowl aft portion and said dome portion are able to move between a first radial position and a second radial position.

7. The liner mounting assembly of claim 1, wherein said dome portion is positioned between said cowl aft portion and said bushings.

8. The liner mounting assembly of claim 1, wherein an intermediate portion of said cowl is configured to shield air flow from directly impacting said bushings.

9. The liner mounting assembly of claim 8, wherein said cowl aft portion is a flange stepped from said cowl intermediate portion.

10. The liner mounting assembly of claim 9, wherein said cowl aft portion is stepped from said cowl intermediate portion by an amount substantially equivalent to a height of said bushings.

11. The liner mounting assembly of claim 1, wherein said liner is an outer liner of said combustor.

12. The liner mounting assembly of claim 1, wherein said liner is an inner liner of said combustor.

13. The liner mounting assembly of claim 12, further comprising a support member fixedly connected between said bushings and a head portion of said pin members.

14. The liner mounting assembly of claim 1, wherein said head portion of said pin members has a diameter greater than a diameter of an opening in said bushings.

15. A combustor for a gas turbine engine having a longitudinal centerline axis extending therethrough, comprising:

(a) an outer liner having a forward end and an aft end, said outer liner being made of a ceramic matrix composite material;

(b) an annular dome having an outer portion and an inner portion, said dome being made of a metal;

(c) a plurality of fuel/air mixers connected to and circumferentially spaced within said dome;

(d) an outer cowl located forward of said dome outer portion having a forward end and an aft end, said outer cowl being made of a metal, wherein said outer cowl aft end and said dome outer portion have separate end points; and, (e) an assembly for mounting said outer liner to said outer cowl and said dome outer portion, wherein said outer cowl aft portion and said dome outer portion are fixedly connected together in an overlapping fashion and movably connected to said outer liner in a radial direction as said outer cowl and said dome outer portion experience thermal growth greater than said outer liner.

16. The combustor of claim 15, said mounting assembly further comprising:

(a) a pin member extending through each one of a plurality of circumferentially spaced openings formed in said forward end of said outer liner, said aft end of said outer cowl, and said dome outer portion, each said pin member including a head portion at one end thereof;

(b) a nut adjustably connected to an end of each said pin member opposite said head portion; and, (c) a bushing located on each said pin member at a position intermediate said head portion and said nut, wherein said openings in said outer liner forward end are sized to fit around said bushings;

wherein said outer cowl aft portion and said dome outer portion are fixedly connected together in an overlapping fashion between said bushing and said nut so that said bushings are able to slide radially through said openings in said outer liner forward end as said outer cowl and said dome experience thermal growth greater than said outer liner.

17. The combustor of claim 15, said outer liner forward end having an area of increased thickness, wherein a plurality of circumferentially spaced partial openings are formed therein, said mounting assembly further comprising:

(a) a pin member extending through each one of a plurality of circumferentially spaced openings formed in said outer cowl and said dome outer portion aligned with said partial openings in said outer liner forward end, each said pin member including a head portion at one end thereof; and, (b) a nut adjustably connected to an end of said pin member opposite said head portion so that said outer cowl aft portion and said dome outer portion are fixedly connected in an overlapping fashion between said nut and said head portions;

wherein said head portion of said pin members is received in said partial openings of said outer liner and able to slide radially therein as said outer cowl and said dome experience thermal growth greater than said outer liner.

18. The combustor of claim 15, wherein said outer liner forward end has a plurality of circumferentially spaced openings formed therethrough, said mounting assembly further comprising:

(a) a pin member extending through each one of a plurality of circumferentially spaced openings formed in said outer cowl and said dome outer portion aligned with said openings in said outer cowl forward end, each said pin member including a head portion at one end thereof; and, (b) a nut adjustably connected to each said pin member at an end opposite said head portion so that said outer cowl aft portion and said dome outer portion are fixedly connected in an overlapping fashion between said nut and said head portions;

wherein said head portion of said pin members is able to slide radially through said openings of said outer liner as said outer cowl and said dome experience thermal growth greater than said outer liner.

19. A combustor for a gas turbine engine having a longitudinal centerline axis extending therethrough, comprising:

(a) an inner liner having a forward end and an aft end, said inner liner being made of a ceramic matrix composite material;

(b) an annular dome having an outer portion and an inner portion, said dome being made of a metal;

(c) a plurality of fuel/air mixers connected to and circumferentially spaced within said dome;

(d) an inner cowl located forward of said dome inner portion having a forward end and an aft end, said inner cowl being made of a metal, wherein said inner cowl aft end and said dome inner portion have separate end points; and, (e) an assembly for mounting said inner liner to said inner cowl and said dome inner portion, wherein said inner cowl aft portion and said dome inner portion are fixedly connected together in an overlapping fashion and movably connected to said inner liner in a radial direction as said inner cowl and said dome inner portion experience thermal growth greater than said inner liner.

20. The combustor of claim 19, said mounting assembly further comprising:

(a) a pin member extending through each one of a plurality of circumferentially spaced openings formed in said forward end of said inner liner, said aft end of said inner cowl, and said dome inner portion, each said pin member including a head portion at one end thereof;

(b) a nut adjustably connected to an end of each said pin member opposite said head portion; and, (c) a bushing located on each said pin member at a position intermediate said head portion and said nut, wherein said openings in said inner liner forward end are sized to fit around said bushings;

wherein said inner cowl aft portion and said dome inner portion are fixedly connected together in an overlapping fashion between said bushing and said nut so that said bushings are able to slide radially through said openings in said inner liner forward end as said inner cowl and said dome experience thermal growth greater than said inner liner.

21. The combustor of claim 19, said inner liner forward end having an area of increased thickness, wherein a plurality of circumferentially spaced partial openings are formed therein, said mounting assembly further comprising:

(a) a pin member extending through each one of a plurality of circumferentially spaced openings formed in said inner cowl and said dome inner portion aligned with said partial openings in said inner liner forward end, each said pin member having a head portion at one end thereof; and, (b) a nut adjustably connected to an end of each said pin member opposite said head portion so that said inner cowl aft portion and said dome inner portion are fixedly connected in an overlapping fashion between said nut and said head portions;

wherein said head portion of said pin members is received in said partial openings of said inner liner and able to slide radially therein as said inner cowl and said dome experience thermal growth greater than said inner liner.

22. The combustor of claim 19, wherein said inner liner forward end has a plurality of circumferentially spaced openings formed therethrough, said mounting assembly further comprising:

(a) a pin member extending through each one of a plurality of circumferentially spaced openings formed in said inner cowl and said dome inner portion aligned with said openings in said inner cowl forward end, each said pin member having a head portion at one end thereof; and, (b) a nut adjustably connected to said pin members at an end opposite said head portion so that said inner cowl aft portion and said dome inner portion are fixedly connected in an overlapping fashion between said nut and said head portions;

wherein said head portion of said pin members is able to slide radially through said openings of said inner liner as said inner cowl and said dome experience thermal growth greater than said inner liner.

23. A method of mounting a liner to a dome and a cowl in a gas turbine engine combustor having a longitudinal centerline axis therethrough, wherein said liner is made of a material having a lower coefficient of thermal expansion than said dome and said cowl, comprising the steps of:

(a) fixedly connecting an aft portion of said cowl and a portion of said dome in an overlapping fashion, wherein said cowl aft portion and said dome portion have separate end points; and, (b) connecting a forward end of said liner to said cowl aft portion and said dome portion in a manner so as to permit radial movement of said cowl aft end and said dome portion with respect to said liner forward end.

24. The method of claim 23, further comprising the step of connecting said forward end of said liner to said cowl aft portion and said dome portion in a manner so as to prevent axial movement of said cowl aft end and said dome portion with respect to said liner forward end.

25. The method of claim 23, further comprising the step of connecting said forward end of said liner to said cowl aft portion and said dome portion in a manner so as to prevent circumferential movement of said cowl aft end and said dome portion with respect to said liner forward end.

* * * * *